US005352170A

United States Patent [19]

Condo et al.

[11] Patent Number: 5,352,170

[45] Date of Patent: Oct. 4, 1994

[54] BOXING TRAINING APPARATUS

[75] Inventors: Girolamao Condo; Luigi Trocola, both of Eislingen, Fed. Rep. of Germany

[73] Assignee: Petra Condo, Eislingen, Fed. Rep. of Germany

[21] Appl. No.: 44,126

[22] Filed: Apr. 8, 1993

[30] Foreign Application Priority Data

Apr. 13, 1992 [DE] Fed. Rep. of Germany ..... 4212374

[51] Int. Cl.[5] ..... A63B 26/00

[52] U.S. Cl. ..... 482/83; 482/87

[58] Field of Search ..... 273/55 R, 55 A; 482/83-90, 148, 904, 907, 23-33

[56] References Cited

U.S. PATENT DOCUMENTS

| | | | |
|---|---|---|---|
| 825,860 | 7/1906 | McKenzie | 482/86 |
| 3,427,021 | 2/1969 | Donato | 273/55 R |
| 4,027,875 | 6/1977 | Hurley | 482/84 |
| 4,491,316 | 1/1985 | Prince | 482/83 |
| 4,819,934 | 4/1989 | Wilson et al. | 482/83 |
| 4,913,419 | 4/1990 | McAuliffe | 482/87 |
| 4,973,045 | 11/1990 | Heberer | 482/83 |

OTHER PUBLICATIONS

Shodan Products Black Belt Feb. 1984 p. 7 Shodan "Apartment Sparring Game".

*Primary Examiner*—Richard J. Apley
*Assistant Examiner*—Jerome Donnelly
*Attorney, Agent, or Firm*—Anderson Kill Olick & Oshinsky

[57] ABSTRACT

A boxing training apparatus for developing aiming and blocking punching techniques includes a punching pad or ball, which is attached to a free end of an arm supported on a substantially vertical column, and elements which provide for adjustment of the arm height, projection and inclination relative to the supporting column.

7 Claims, 2 Drawing Sheets

BOXING TRAINING APPARATUS

BACKGROUND OF THE INVENTION

The invention relates to a boxing training apparatus for developing aiming and blocking punching techniques, which apparatus can also be used in so-called Taekwondo training. Special apparatuses of this type are not presently known, except for conventional suspended punching bags, punching balls and the like. Because of the hardness of punches in boxing, the conventional training methods lead to an increased risk of accidents and injury as of sportsmen so of coaches.

Accordingly, the main object of the invention is a training apparatus which, on one hand, would permit to reduce the foregoing risks and, on the other hand, would provide simple means for training, and which would be inexpensive, easily adjustable, can be installed in a room, garage, and the like, and would provide unlimited possibilities for training special skills and actions.

SUMMARY OF THE INVENTION

This and other objects of the invention are achieved by providing a training apparatus including a punching pad, punching ball and the like which is attached to a free end of an arm supported on a substantially vertical column in such a manner that the arm height, projection and inclination relative to the column may be adjusted, as necessary.

BRIEF DESCRIPTION OF THE DRAWINGS

The features and objects of the present invention will become more apparent and the invention itself will be best understood from the following detailed description of the preferred embodiments when read with reference to the accompanying drawings wherein.

DETAILED DESCRIPTION OF THE PREFERRED EMBODIMENTS

Figure 1:
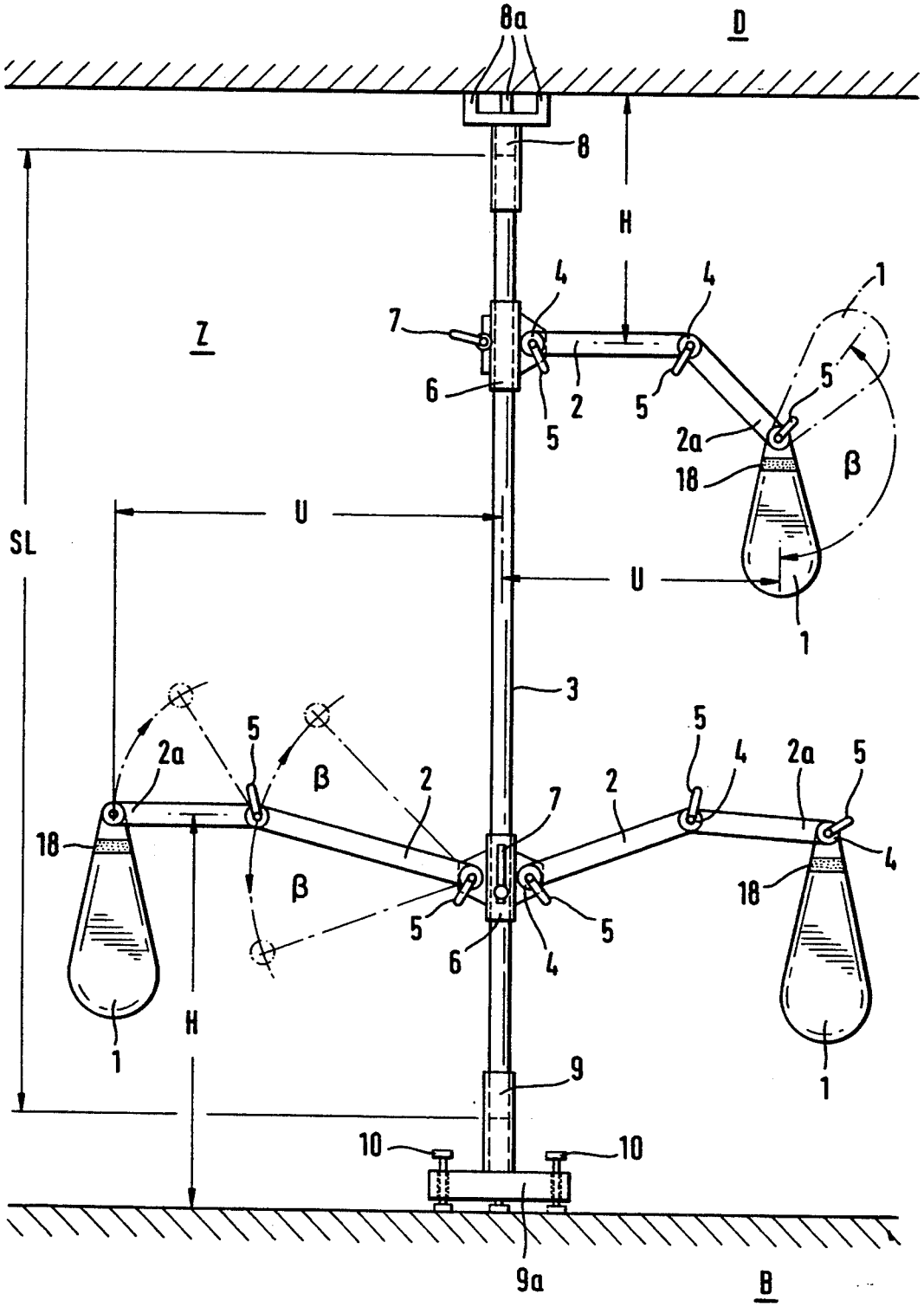
FIG. 1 shows a schematic view of a training apparatus according to the present invention.

The training apparatus according to the present invention is designed for developing aiming and blocking or deflecting punching technique. The apparatus includes a punching pad 1 secured to a free end *2a* of an arm 2. The arm 2, together with the punching pad 1, is supported on a preferably vertical column 3 with a possibility of a height-adjustment. A projection "U" of the arm 2 and/or inclination B are also adjustable. The arm 2, *2a* has at least one hinge point 4 with a locking element, e.g., an attachment screw or a toggle 5, or is formed such that the arm projection is telescopically adjustable. The arm 2 may be provided with a displacement sleeve 6 with a locking element 7 for being mounted on the column 3. By adjusting the arm height, projection and/or inclination relative to the support column 3, a desired individual position of the punching pad 1 can be adjusted.

The column 3 may be provided with a heavy base so that it can be freely placed on the ground or floor, or with a cap with which it can be firmly secured to a ceiling of a room.

Figure 2:
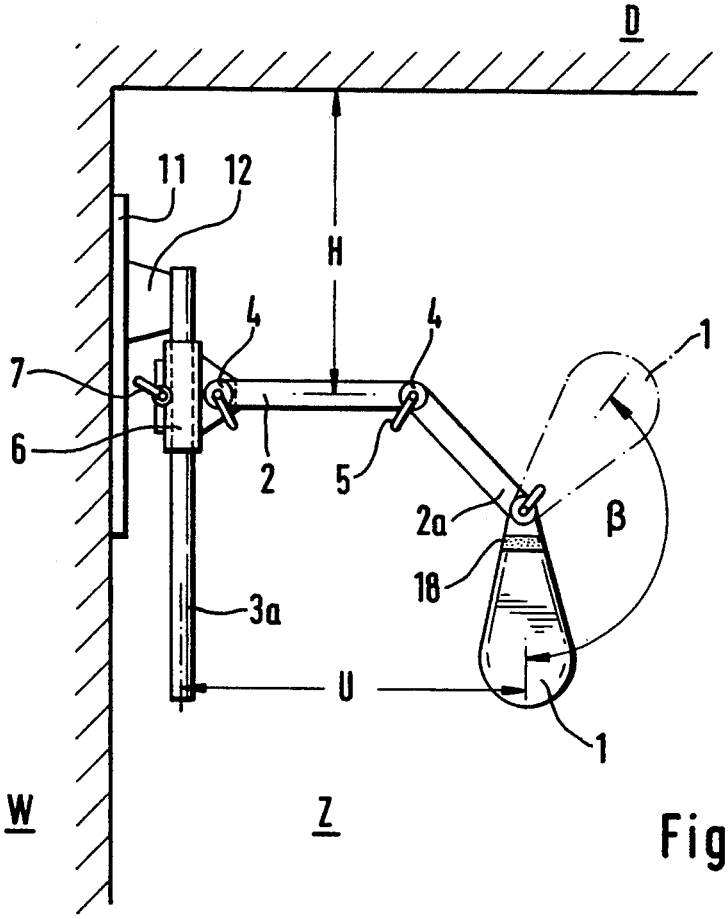
FIG. 2 shows a schematic view of a modified portion of the apparatus shown in FIG. 1.
Figure 3:
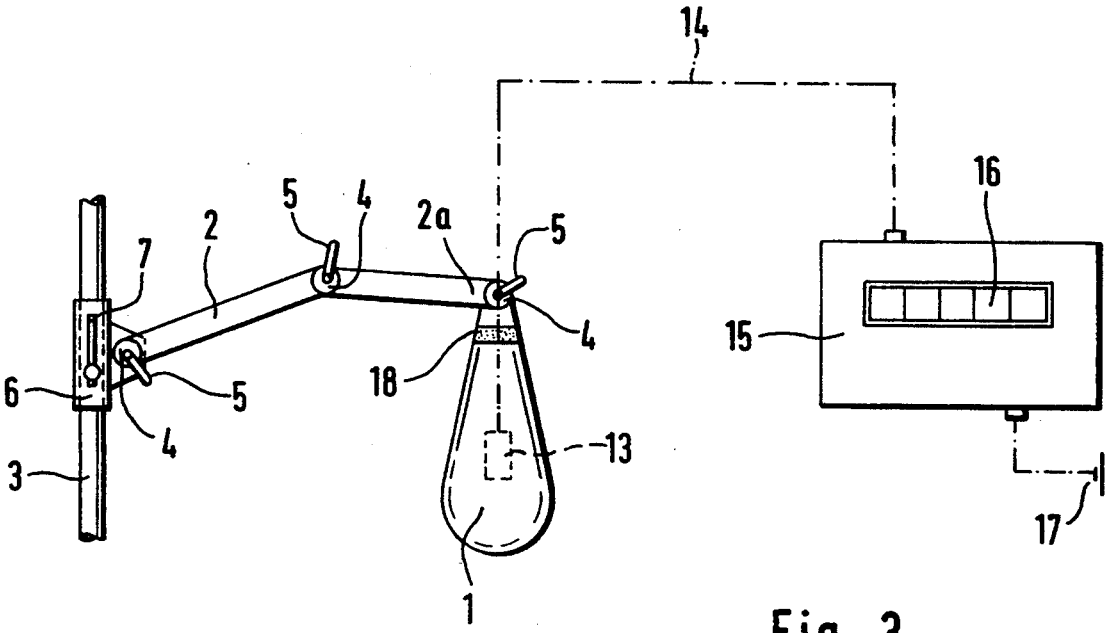
FIG. 3 shows a schematic view of yet another modified portion of the training apparatus according to the present invention.

In the embodiment shown in FIG. 2, the column element *3a* is provided with a spacer 12 with which it is attached to a wall bracket 11, which in turn can be secured to a wall "W" of a gym, room, etc.

If no suitable space is available in which the training apparatus can be permanently placed, it is recommended that the column 3 be made telescopic or otherwise adjustable along its length SL, as well as be provided with adjustable head and/or base 8 and 9, respectively, so that it can be extended between the floor "B" and the ceiling "D" of the room "Z". For a reliable installation, it is advantageous when at least one of the members 8 and 9 is formed as a three-prong forked member *8b* or *9b* or the like and, preferably, a locking screw 10 or the like is provided on each prong *8a* and *9a*.

The training apparatus according to the invention may be improved by being equipped with a mechanical and/or electronic measuring device 15 with a scale 16, a power source 17, and respective conductor means 13, 14 extending to the punching pad or ball for counting punches and/or for showing the intensity and the force of the punches. The usefulness range of the training apparatus according to the invention can be expanded by use of different interchangeable punching pads 1 as well as by use of other training elements, e.g., a punch ball and the like.

It is also conceivable, for adjusting the training apparatus, that the arm 2, *2a*, with or without the displacement sleeve, in addition to the height adjustment "H", is also longitudinally adjustable in a horizontal plane.

Further, instead of a hinge joint 4, oppositely rotatable discs with teeth formed on their abutting surfaces or apertured discs with socket pins, which are connected with locking screws 5, can be used for adjusting the arm 2.

For reducing the mechanical stresses acting on the hinge point 4 and the adjusting element 5, a rubber or other shock-absorbing intermediate member 18 may be advantageously provided between the free end *2a* of the arm 2 and the punching pad 1.

While particular embodiments of the invention have been shown and described, various modification thereof will be apparent to those skilled in the art and, therefore, it is not intended that the invention be limited to the disclosed embodiments or to the detail thereof, and the departures may be made therefrom within the spirit and scope of the invention as defined in the appended claims.

What is claimed is:

1. A boxing training apparatus for developing aiming and blocking punching techniques, comprising an arm having a free end; punching means secured to said free end of said arm; a substantially vertical support means for supporting said arm; and means for adjusting the height, of said arm relative to said support means;

wherein said arm has a first arm portion and a second arm portion attached to said first arm portion at one end thereof, with another end of said second arm portion opposite said one end defining said free end;

wherein said adjusting means includes first hinge means for pivotally attaching said first arm portion to said support means, and second hinge means for pivotally attaching said second arm portion to said first arm portion and a third hinge means for pivotally attaching said punching means, thereby providing means for adjusting the projection and inclination of said arm; and the projection of said punching bag means relative to said support member, wherein each of said first and second hinge means comprise means for looking a respective one of said first and second arm portions in a predetermined pivotal position.

2. A boxing training apparatus according to claim 1, wherein said locking means comprises one of an attachment screw and a toggle.

3. A boxing training apparatus according to claim 1 wherein the projection of said arm is longitudinally adjustable.

4. A boxing training apparatus according to claim 1, wherein said adjusting means includes a displacement sleeve and a locking element associated with said sleeve for height-adjusting a position of said arm on said support means.

5. A boxing training apparatus according to claim 1, wherein said punching means comprises a punching ball.

6. A boxing training apparatus according to claim 1, further comprising a shock-absorbing intermediate resilient member arranged between said free end of said arm and said punching means.

7. A boxing training apparatus according to claim 1, further comprising measuring means for at least one of counting punches and displaying punch intensity and force.

* * * * *